US006341573B1

(12) United States Patent
Buck

(10) Patent No.: US 6,341,573 B1
(45) Date of Patent: Jan. 29, 2002

(54) SHIP TO PLATFORM TRANSFORMER

(76) Inventor: Jon Buck, 6930 Sykesville Rd., Sykesville, MD (US) 21784

( * ) Notice: Subject to any disclaimer, the term of this patent is extended or adjusted under 35 U.S.C. 154(b) by 0 days.

(21) Appl. No.: 09/681,258

(22) Filed: Mar. 9, 2001

(51) Int. Cl.[7] ..... B63B 35/50
(52) U.S. Cl. ..... 114/261; 114/258; 114/265
(58) Field of Search ..... 114/258, 261, 114/265, 266, 125, 259, 260, 262, 264

(56) References Cited

U.S. PATENT DOCUMENTS 2,238,974 A * 4/1941 Creed ..... 114/265
2,399,611 A * 5/1946 Armstrong ..... 114/261
3,673,973 A * 7/1972 Glosten ..... 114/265
3,708,985 A * 1/1973 Pogonowski et al. ..... 405/202
3,739,737 A * 6/1973 Baier ..... 114/265
3,922,868 A * 12/1975 McDonald et al. ..... 61/46.5
4,127,004 A * 11/1978 Vilain ..... 405/202
4,141,668 A * 2/1979 Engel ..... 405/202
4,703,709 A * 11/1987 Behar et al. ..... 114/256
5,398,635 A * 3/1995 Tellington ..... 114/261
5,906,171 A * 5/1999 Kristensen et al. ..... 114/261
6,196,151 B1 * 3/2001 Grant et al. ..... 114/266

* cited by examiner

*Primary Examiner*—S. Joseph Morano
*Assistant Examiner*—Ajay Vasudeva

(57) ABSTRACT

A ship convertible to a floating aircraft runway supported above water level by slender vertical buoyant legs, and capable of remaining stable during inclement weather conditions. The slender buoyant legs lifts the upper hull above the water level by pivoting downwardly from a retracted horizontal configuration to a vertical configuration by shifting ballast. Waterjet propulsion units maintain or change the position of the ship when the legs are in the horizontal or the vertical configuration. The runway has an area sized to launch and land large fixed-wing aircraft in a substantially horizontal direction without a need for a catapult or a landing assist method.

2 Claims, 3 Drawing Sheets

SHIP TO PLATFORM TRANSFORMER

FEDERAL RESEARCH STATEMENT

[No federally sponsored research or development dollars where used in the development of this patent.]

BACKGROUND OF INVENTION

Field of the Invention

Naval Architecture, ship operations, and mobile logistics bases is the area of application for this invention. There is a need in the military and private sector for a ship that can serve as both a transit vessel and a fixed platform. In the military a ship that can transform itself from a horizontal displacement hull vessel into a floating platform can be used as a forward mobile base. This base may server as a logistic port and/or as an air base. The ideal situation is to have a fast transport ship, to carry cargo and personnel that can at high-speed sail to an areas of conflict. The shortfall with conventional ships such as carriers is that they require specialized catapult launched aircraft, are very expensive, and do not have general logistic support capabilities. Another approach is to have a floating platform such as a semi-submersible, similar to what is used in the oil production industry, to provide the forward fixed base. The disadvantage with semi-submersibles is that they are very slow or need to be towed to the forward site, which may take weeks or months. There is a technology need to provide a rapid transit ship, which can also act as a floating platform. The problem with conventional horizontal displacements ships is that in a stationary moored situation they respond very severely to sea conditions and the resultant motions prevents, or severely limits, aircraft and logistics operations. A floating platform supported by long vertical slender buoyant legs, provides the most stable platform configuration and respond very little to waves and sea conditions. However, a platform supported by long vertical slender buoyant legs is very difficult to transport. This invention solves all of the above listed problems and shortcoming by providing a conventional horizontal hull displacement ship which may transit at high speed to a desired location, then be transformed into a long vertical slender buoyant leg platform that provides high quality stability.

The following is a Description of Related Applications: The most closely related technologies are the Mobile Offshore Base, which uses semi-submersible floating platforms connected together to make up a large platform configuration, oil drilling and production platforms, and the aircraft carrier. The Mobile Offshore Base is composed of several semi-submersibles connected together and they do not provide for wave motion isolation. The oil drilling and production platforms are a semi-submersible rigid structure which has submerges horizontal cylindrical bodies similar in shape to a submarine, which have struts leading up through the water surface to support a platform, see references U.S. Pat. Nos. 4,273,067; 4,361,104. This arrangement called a semi-submersible platform is used extensively in the offshore oil industry for drilling and production rigs. The semi-submersible is a ridge structure which can not change it's shape. Often the semi-submersibles are fixed to the bottom while on site with anchor wires to a submerged gravity base and can not position them selves relative to the waves or wind, see reference U.S. Pat. No. 4,378,178. The semi-submersibles are often without propulsion and are towed to their locations. The aircraft carrier is a conventional mono-hull ship with a flight deck for aircraft operations. The aircraft carrier is self-propelled and of a single hull configuration, which cannot be coupled together to make a lager airfield platform. The carriers are not designed to sit motionless at one location and launch aircraft; the ship needs forward motion, catapults, and arresting gear to conduct air operations. Some carriers do not have catapults but have a jump ski bow ramp to launch V/STOL aircraft, they can not handle conventional air craft operations, see reference U.S. Pat. No. 5,218,921. There are carrier designs that are formed from sections of floating barges, or pontoons and/or semi-submersibles that are connected together to form a flight operations platform. This type of floating platform structures set on the surface of the water and is subject to high resultant motions. High wave forces require them to have fellable connectors, see references U.S. Pat. Nos. 5,906,171; 5,529,012. Also there are ridged platform structures comprising a deck and floating support sections as a single truss structures, but their size are limited due to wave and sea loading, they also are not inherently low motion vessels because they are not isolated from the sea, see reference U.S. Pat. Nos. 4,481,899; 5,398,635. Some semi-submersible platforms use water jet from of propulsion to maintain dynamic position, however these Waterjets are in a fixed horizontal mode and can not provide azimuth thrusting in a vertical position, see reference U.S. Pat. No. 4,580,517.

SUMMARY OF INVENTION

This Ship to Platform Transformer invention is composed of an upper platform and lower buoyant hull, where the lower hull swings from a horizontal position configuration to vertical buoyant leg configuration, the lower hull is attached to the upper platform by a hinge around which the lower hull transforms into the vertical buoyant leg. The Ship to Platform Transformer invention is designed to utilize a conventional horizontal ship hull configuration to transit the ocean at a fast speed. Once several of the Ship to Platform Transformers arrives at their final destination, the upper hulls are connected together to form a large integrated platform. Ballast in the lower hull is transferred to the stern of the ship allowing the lower hull to pivot around the hinge point. The upper hulls, now connected as one large platform, become supported by the combination of a multitude of all the vertical buoyant legs. Because the vertical buoyant legs have very small water-plane area at the surface they react very little to the waves, thus the upper hull platform is a stable platform for conventional aircraft and port logistics operations.

DETAILED DESCRIPTION

Figure 1:
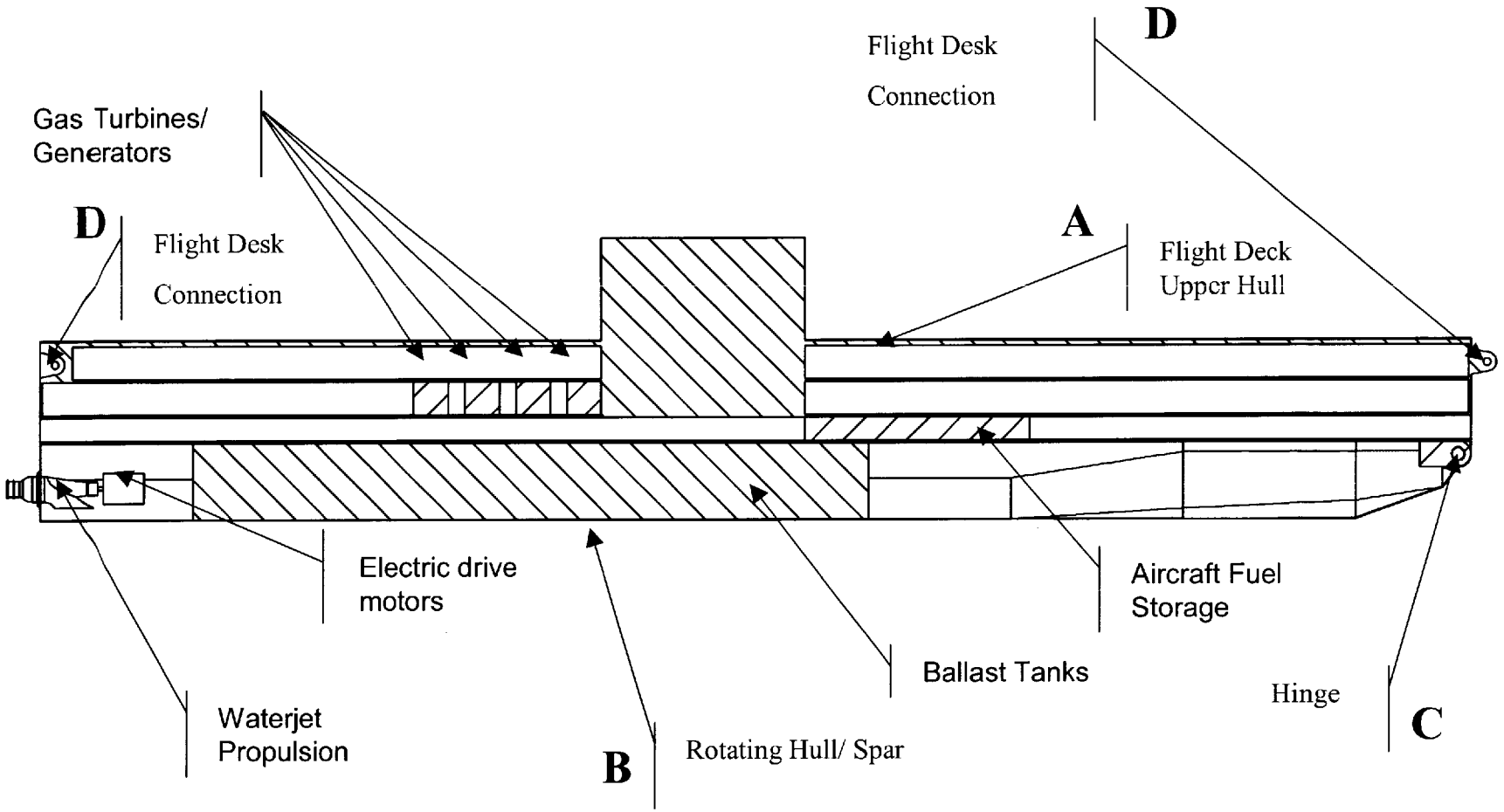
FIG. 1 shows an elevation of the horizontal configuration and identifies the major working elements of the concept.
Figure 2:
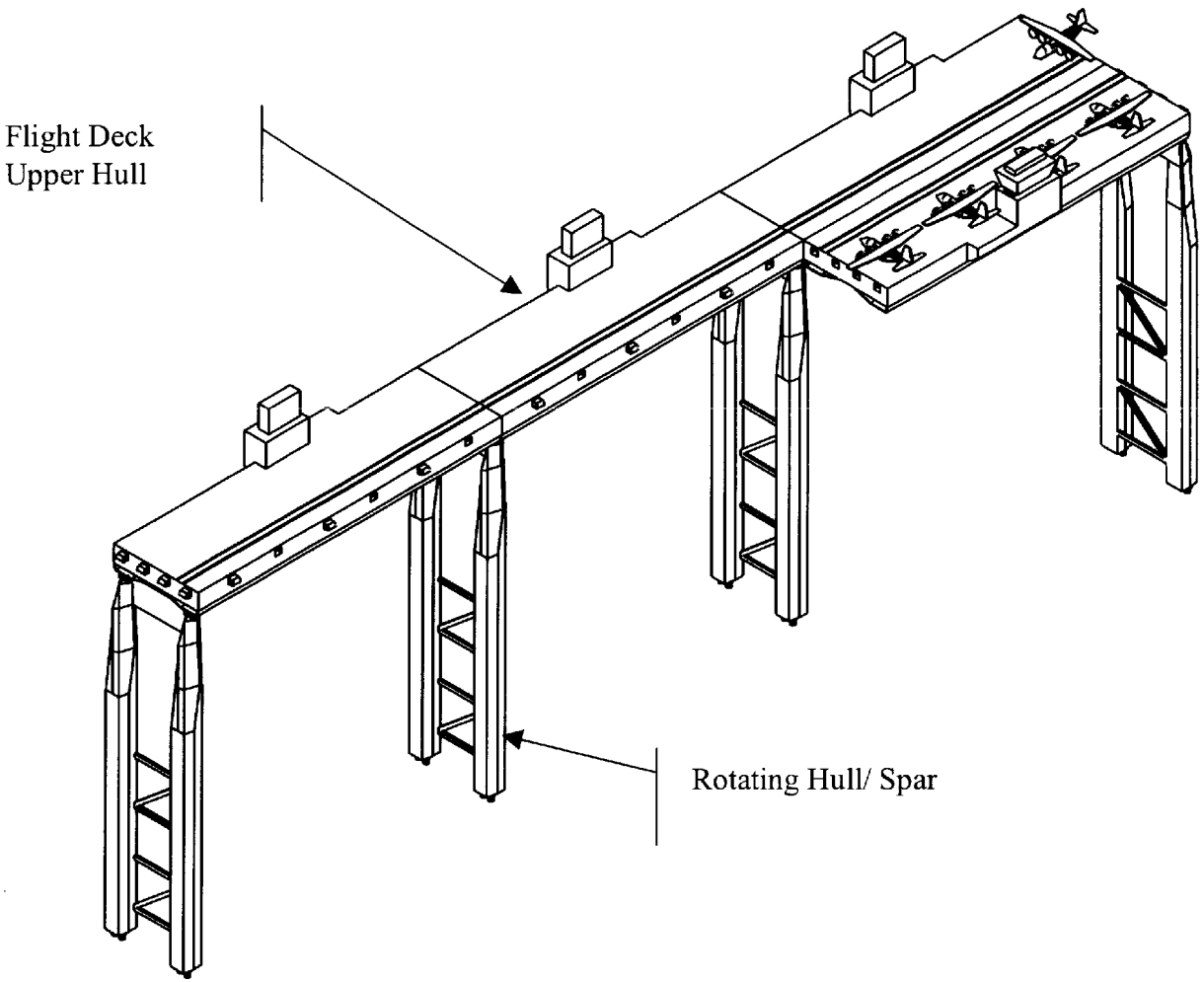
FIG. 2 shows an isometric of several Ship to Platform Transformers attached together to make up an integrated large floating platform group.
Figure 3:
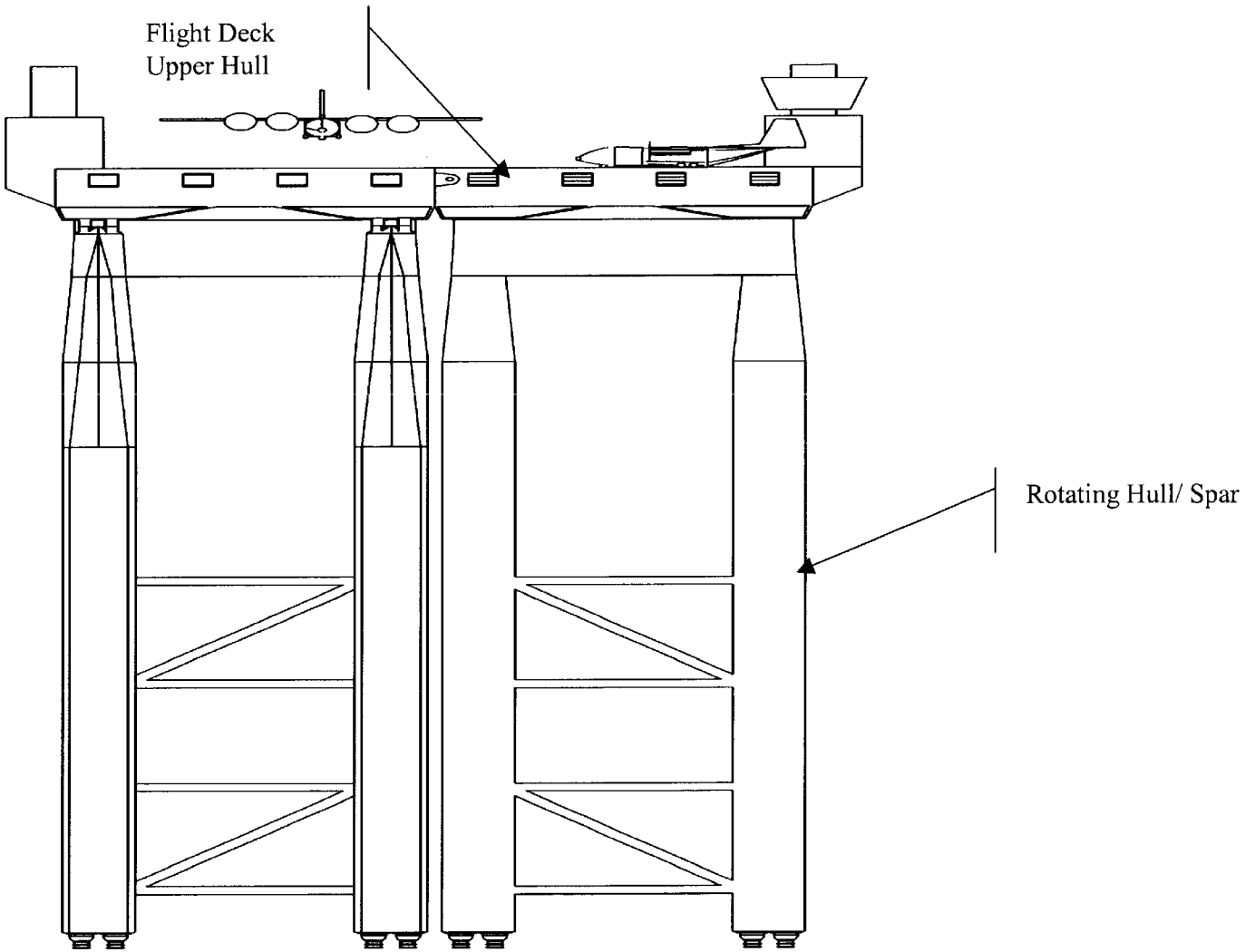
FIG 3 shows and end view of the Ship to Platform Transformers connected together side-by-side to make an airfield.

This Ship to Platform Transformer invention is composed of a two-part ship, with an upper platform Upper Hull (1), and a lower Rotational Horizontal to Vertical Hull (2), see FIG. 1. The Upper Hull (1) and lower Rotational Horizontal to Vertical Hull (2) are attached at a Hinge Pivot (3). This Hinge Pivot (3) is the point around which the lower Rotational Horizontal to Vertical Hull (2) rotates from the horizontal to vertical buoyant leg configuration. The Rotational Horizontal to Vertical Hull (2) makes the transition from orizontal to the vertical buoyant leg configuration by shifting liquid in the Ballast Tanks (4) from the Forward (5) position of the ship to the Aft (6) position of the ship. By shifting the liquid in the Ballast Tanks (4) the two-part ship transforms from a horizontal conventional ship hull configuration, to a platform supported by vertical buoyant legs configuration. To make a completed platform assembly at least two Ship to Platform Transformer must be connected together. Two or more Ship to Platform Transformers are connected together Bow (7) to Stern (8) at the Upper Hull Connections points, see FIG. 2. For visualization of the Upper Hull, Bow (7) to Stern (8) connection see the isometric view in Drawing 200. As shown in FIG. 3, the Ship to Platform Transformers may also be connected together Starboard (9) to Port (10) to form an assembled platform. The Ship to Platform Transformers invention concept provides for any numbers of bow to stern, and/or port to starboard configurations to make-up any number of platforms arrangements supported by the vertical buoyant legs. The naval architecture invention concept for the Ship to Platform Transformers is such that the Upper Hull (1) sets atop a lower multi-hull Rotational Horizontal to Vertical Hull (2) as it operates as a conventional displacement configured ship. The lower Rotational Horizontal to Vertical Hull (2) may be configured as a single, catamaran, or multi-hull ship. In FIG. 1 the main power plant is shown as a Gas Turbine/Generator (11), but this for illustration purposes only as any engine/generator system may be acceptable, which is located in the Upper Hull (1). The propulsions is shown as a Waterjet (12) which is driven by Electric Drive (13), but this is for illustration purposes only as any propulsions system may be acceptable, and are located in the Rotational Horizontal to Vertical Hull (1). The operating concept for the Ship to Platform Transformers is for the ships to transit to a desired location at high speed employing the horizontal hull configuration. Once on station the hulls are connected together, the lower hulls are pivoted down and the whole assembly turns into large platform supported by the vertical buoyant leg configuration. A platform supported by long slender vertical buoyant legs has very little motions as waves pass by. The amount of dynamic changing buoyancy caused by the passage of waves is very small due to the small water plane area of the vertical buoyant legs near the surface. As the waves pass by they impart little affect and the resultant motion, and wave forces exerted on the platform are low. Therefore, the long slender vertical buoyant legs configuration is a very stable platform. The unique feature of the Ship to Platform Transformers results from the ability to transform from a high-speed ship configuration, with poor motions characteristics in a seaway, to a platform supported by slender vertical buoyant legs, which are inherently stable in a seaway. Once the Ship to Platform Transformers is on site and configured into a stable platform mode, which may be a variety of sizes and configurations, it may maintain its position, and/or change it position, and/or move about with respect to the sea and wind conditions by directing the thrust of the Waterjets (12), see FIG. 3. The Waterjets (12) provides both propulsion while in the horizontal fast transit mode, and station keeping and maneuvering control while in the platform mode.

What is claimed is:

1. A ship convertible to a floating aircraft runway supported above water level by slender vertical buoyant legs, said ship comprising:

a buoyant horizontal upper hull having an elongate top surface;

a plurality of slender buoyant legs disposed below the upper hull and attached to the hull by hinges, the legs being pivotable about the hinges to rotate downwardly from a retracted horizontal configuration to an extended vertical configuration for lifting the upper hull above water level, wherein a horizontal-to-vertical transformation of the buoyant legs is caused by shifting ballast from a forward portion to an aft portion of each leg when the legs are disposed in the horizontal configuration, said ballast accumulating in a lower portion of the legs as the legs pivot downwardly to assume the vertical configuration;

a waterjet propulsion means for the ship, said propulsion means adaptable for maintaining or changing position of the ship when said legs are in the horizontal or the vertical configuration;

wherein the entire top surface of the upper hull comprises the runway, and has an area sized to launch and land large fixed-wing aircraft in a substantially horizontal direction directly on the runway without a need for a catapult or a landing assist method.

2. The ship as claimed in claim 1, further comprising:

coupling means disposed on the upper hull, and adaptable to couple the upper hull to a plurality of upper hulls of similarly configured ships for assembling into a large floating platform.

* * * * *